United States Patent [19]

Heffernan

[11] 4,371,330

[45] Feb. 1, 1983

[54] ADJUSTABLE SCREED BAR APPARATUS

[75] Inventor: Peter C. Heffernan, Piedmont, S.C.

[73] Assignee: W. R. Grace & Co., Cambridge, Mass.

[21] Appl. No.: 189,262

[22] Filed: Sep. 22, 1980

[51] Int. Cl.[3] ..... B28B 1/29; E01C 19/22

[52] U.S. Cl. ..... 425/458; 280/12 R; 404/118

[58] Field of Search ..... 425/458, 62; 404/118, 404/119, 120; 172/360, 361, 387, 392, 393; 37/122, 123; 280/12 R, 12 A, 12 AA, 12 C, 12 E, 12 H, 12 KL, 12 L, 12 M, 12 S, 16, 17, 21 R, 24, 28

[56] References Cited

U.S. PATENT DOCUMENTS

| | | | |
|---|---|---|---|
| 150,450 | 5/1874 | Wiard | 172/387 |
| 233,815 | 10/1880 | Sornberger | 172/387 |
| 882,751 | 3/1908 | Edwards | 172/387 |
| 966,081 | 8/1910 | Casner | 172/387 X |
| 1,037,194 | 9/1912 | Berger | 404/118 X |
| 1,045,080 | 11/1912 | Purnell | 172/387 |
| 1,068,155 | 7/1913 | Mosher | 404/118 X |
| 1,318,419 | 10/1919 | Vathing et al. | 172/387 |
| 1,827,237 | 10/1931 | Jones | 280/12 R |
| 1,857,479 | 5/1932 | Royer | 172/387 X |
| 2,108,541 | 2/1938 | Lull | 280/12 R |
| 2,141,301 | 12/1938 | Jackson | 94/43 |
| 2,249,264 | 7/1941 | Baily | 94/48 |
| 2,387,748 | 10/1945 | Cuddigan et al. | 172/360 |
| 2,746,367 | 5/1956 | Ferguson | 94/19 |
| 2,987,125 | 6/1961 | Singleton | 172/393 |
| 3,298,291 | 1/1967 | Layton | 94/45 |
| 3,555,983 | 1/1971 | Shisher, Jr. et al. | 94/46 |
| 3,559,543 | 2/1971 | Schwoebel, Jr. | 94/44 |
| 3,559,544 | 2/1971 | Miller | 94/45 |
| 3,691,916 | 9/1972 | Martenson et al. | 94/46 |
| 3,816,014 | 6/1974 | Klopf | 404/114 |
| 3,872,931 | 3/1975 | Camp | 172/387 |
| 4,005,859 | 2/1977 | Tait | 280/21 R X |
| 4,083,131 | 4/1978 | Auer | 280/12 R X |
| 4,189,886 | 2/1980 | Frolich et al. | 52/302 |

FOREIGN PATENT DOCUMENTS

| | | | |
|---|---|---|---|
| 118751 | 8/1944 | Australia | 172/387 |
| 577768 | 6/1959 | Canada | 404/118 |
| 40639 | 8/1929 | Denmark | 172/387 |
| 250509 | 9/1912 | Fed. Rep. of Germany | 280/21 R |
| 843856 | 9/1952 | Fed. Rep. of Germany | 404/118 |
| 1945404 | 9/1970 | Fed. Rep. of Germany | 172/387 |
| 1495370 | 9/1957 | France | 172/387 |
| 1309994 | 10/1962 | France | 172/387 |
| 1477774 | 4/1967 | France | 280/12 R |
| 103074 | 10/1963 | Norway | 280/12 E |
| 439223 | 12/1935 | United Kingdom | 404/119 |
| 911623 | 11/1962 | United Kingdom | 404/118 |
| 974825 | 11/1964 | United Kingdom | 404/119 |
| 388081 | 10/1973 | U.S.S.R. | 404/118 |

OTHER PUBLICATIONS

Advertisement Entitled "Increase Productivity Decrease Costs" from the trade magazine The Roofing Spec., Sep., 1980.

*Primary Examiner*—Philip Anderson

*Attorney, Agent, or Firm*—William L. Baker; C. Edward Parker

[57] ABSTRACT

An adjustable screed bar for leveling wet fluid concrete mixtures such as layers of lightweight thermal-insulating concretes cast on rooftops of buildings and the like is described. The device is in the form of a shaft having a screed bar bracket means slidably mounted on one end thereof and a sled runner at the other end. At least two of these devices are attached to a screed bar at spaced apart locations and permit the bar to be pulled or pushed through the wet mixtures at any desired height.

2 Claims, 2 Drawing Figures

ADJUSTABLE SCREED BAR APPARATUS

BACKGROUND OF THE INVENTION

1. Field of the Invention

This invention relates to a device for adjustably leveling a material capable of being doctored, such as a wet, fluid thermal-insulating concrete composition after it has been applied to a surface.

2. Description of the Prior Art

Lightweight thermal-insulating concretes are used as thermal-insulating layers in roofs, etc., of buildings and the like. Such compositions, which are typically mixtures of essentially cement binder, lightweight aggregate such as expanded vermiculite or perlite, and water, are usually mixed at the job-site and pumped to the rooftop, etc., of the building. The compositions are highly fluid and have the consistency somewhat of "shaving cream" when cast on the roof deck. One comerically popular roofing system using layers of such insulating concretes is described and shown in U.S. Pat. No. 4,189,886 to Frohlich et al.

When the light, highly fluid insulating concrete has been applied to a roof deck surface, one way to obtain the desired height of the concrete coating is to place rails on each side of the area being coated. The height of each rail is the height of the desired coating. Then a bar or board called a screed bar is pulled along the top of these two rails to level by doctoring the material so that the final coating obtained is the desired height. The problem with this technique is that it is then necessary to have a workman step into the area that has just been coated, remove the rails, fill in the empty space left by the rails with the coating material and as the workman backtracts to also fill in his footprints. A further disadvantage of this technique is that since the thickness of the material being poured at any location may vary, it is necessary to carry to the job site rails of different thickness and these rails can easily be misplaced or damaged while moving from job to job in the back of a truck.

3. Objects of the Invention

It is an object of this invention to have an adjustable doctoring device that will ride on the surface being coated and which has a doctor board or screed bar that is completely adjustable to any desired height.

It is a further object of this invention to have an adjustable doctoring device that is supported by two narrow skid runners which ride on the surface being coated so that as the device is pulled through a wet material being applied (such as lightweight insulating concrete), the narrow track openings made by the runners can be filled in by the material itself.

It is a further object of this invention to have an adjustable screed bar support assembly in the form of a shaft with a sled runner at one end and an adjustable screed bar bracket on the shaft which can move up and down the shaft to any locked positions and in which the shaft will not rotate with respect to the bracket and sled runner.

These and further objects will become apparent as the description of the invention proceeds.

SUMMARY OF THE INVENTION

The present device comprises an adjustable screed bar support assembly in the form of a shaft with a screed bar bracket means slideably mounted on one end of the shaft and with a sled runner attached at the other end. When at least two of these members are attached to a screed bar at spaced apart locations, they permit the bar to be pulled through wet, fluid lightweight insulating concrete at any desired height.

The adjustable screed bar support assembly is made of a shaft which preferably is in the form of a rod in which a diametrical slot has been cut in one end to permit the insertion of a sled runner. The sled runner is maintained in the slot and any type of fastening means such as a bolt or a clevis pin is passed through the shaft and the runner to lock the runner in place. The front end of the runner is curved to permit the runner to move through the wet concrete and to float over irregularities in the substrate being covered (e.g. corregated metal roof decking).

At the other end of the shaft is a screed bar bracket means which is adjustably mounted on the shaft so it can be raised and lowered to any desired position. One preferred example of construction is to have a screed bar bracket in the form of an L-shaped piece of metal. The long side of the "L" is parallel to the shaft and the short side extends out at the top. Angle iron pieces are welded to the top and bottom of the back of the long side of the bracket. The other half of each of the angle irons, which extend perpendicularly from the screed bar bracket, has a hole drilled larger than the shaft diameter. Welded to each of these half pieces is a collar with locking thumbscrew so that the opening in the collar and the half piece are congruent. By sliding the two collars and angle iron halves over the shaft, the attached screed bar bracket is mounted on the shaft. The thumbscrews can be tightened to lock the bracket in place after the bracket assembly has been moved along the shaft to the desired height. To prevent rotation of the collar and the screed bar support bracket assembly with respect to the sled runner below, a channel can be formed in the shaft adjacent the thumbscrew into which the thumbscrew will lock.

When the device is to be used on the job site, two of these adjustable screed bar support assemblies are placed at opposite ends of the screed bar and the bar is then placed up into the inside corner of the L-shaped screed bar support bracket. The screed bar is then fastened to the support bracket by any appropriate means. A preferred fastening system utilizes aviation type hose clamps on either side of the shaft which pass around the bracket and the screed bar to lock the screed bar tightly to the bracket. With a screed bar support assembly on either end of the screed bar, the bar can then be pulled along either by manually pulling the bar or by attaching a rope. By adjusting the thumbscrews on the two collars on each end of the screed bar, the screed bar can then be moved up and down to the desired height from the bottom of the runner.

DESCRIPTION OF THE PREFERRED EMBODIMENT

Figure 1:
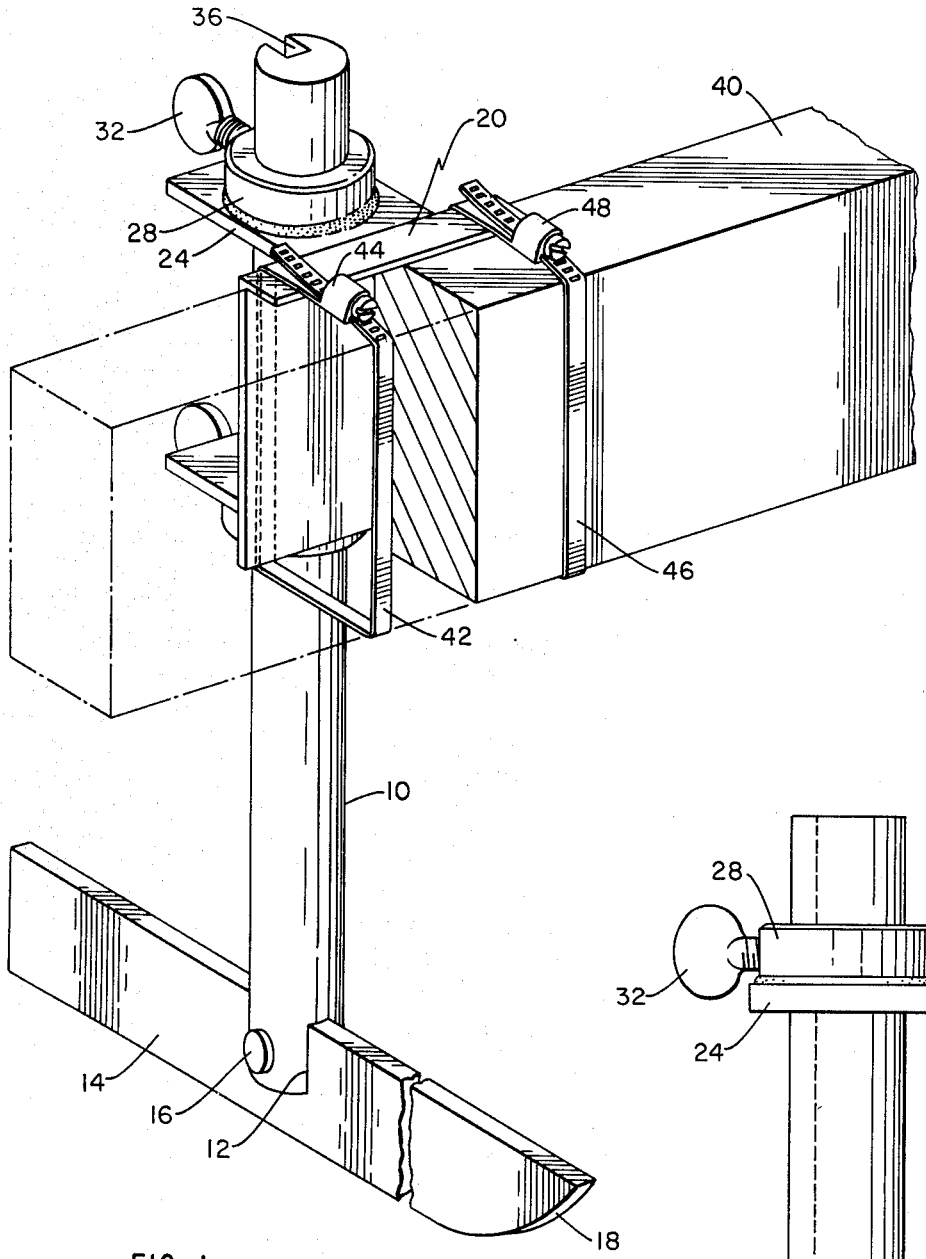
FIG. 1 is a perspective view of one end of the adjustable screed bar apparatus.

The screed bar support member, in its preferred embodiment, is shown in FIG. 1. The vertical shaft 10 has cut into its bottom end a diametrical slot 12. Into this slot is inserted a sled runner 14 and it is secured in place by any suitable fastening means such as the clevis pin 16 illustrated. The front end of the sled runner is curved to facilitate the sled runner slide through the wet concrete. This sled runner can preferably be about 12 inches long and 1½ inches high. By making a narrow sled runner on the order of only ⅛ inch, the runner can easily pass through the concrete. After the runner has passed through, only a small amount of concrete is required to flow back to fill in the track.

Figure 2:
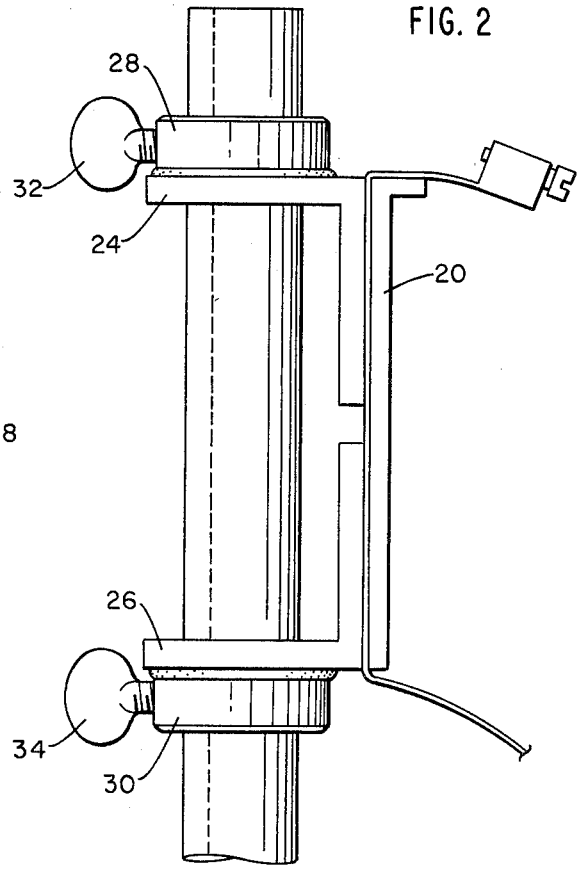
FIG. 2 is a detailed side view of screed bar bracket mounted on the shaft.

At the opposite end of the vertical shaft 10 is the screed bar support bracket 20 which is L-shaped with a small lip side on top and the substantial, long, side descending vertically and spaced parallel to the shaft. This bracket 20 is attached to the shaft 10 by means of a top angle iron 24 and a bottom angle iron 26 as shown in FIG. 2. Each of these angle irons has one half welded to the back of the support bracket 20. The other half of the angle iron extending perpendicularly from the bracket has a hole drilled therein which passes over the shaft. Welded to the top angle 24 is a collar 28 with a locking thumbscrew 32 and similarly welded to the bottom angle iron 26 is collar 30 with its locking thumbscrew 34. To insure that the sled runner 14 does not toe-in with respect to the bracket when the device is used, a channel 36 is formed in the shaft 10 on the side of the shaft adjacent the thumbscrews. As the thumbscrews 32 and 34 are screwed into their collars, they seat down inside the channel 36. Once the thumbscrews are tightened down to this position, the collar will not rotate and the screed bar support bracket 20 is assured to be in a fixed, non rotatable relation with the sled runner 14. The screed bar support bracket can be raised or lowered by loosening the thumbscrews 32 and 34, lowering or raising the bracket assembly to the desired height and then locking the thumbscrews 32 and 34 in place.

When the device is to be used on a job site location, a screed bar support assembly is placed at each end of the screed bar. One end is shown in FIG. 1, where the screed bar 40 is placed up against the screed bar support bracket 20. The bar is then fastened to the bracket 20 by any type of suitable fastening means. In the preferred embodiment illustrated, aviation type hose clamps 42 and 46 are used where the strap passes back behind the screed bar support bracket 20 down around and under the screed bar 40 and back up to the top where the work screw tightens the straps in the housings 44 and 48. It is preferred to have a hose clamp on either side of the shaft so each screed bar support assembly has two hose clamps.

A similar construction is employed at the opposite end of the screed bar 40, not shown. The thumbscrews at each end can be loosened, the bar and bracket assembly moved either up or down to the appropriate height, and then the thumbscrews locked in place to begin operation. The bar is then placed in the wet concrete and it is either pulled by hand through the concrete or with a rope or other handle type device to pull the entire bar assembly through the wet concrete. As the screed board 40 passes through the concrete, it doctors off the excess concrete so that a level coating is obtained which is at the height of the bottom of the screed bar 40.

What is claimed:

1. An adjustable screed bar assembly for leveling wet fluid layers of lightweight thermal-insulating concrete cast over substrates, said assembly comprising;

(a) a horizontally arranged screed bar of rectangular configuration for leveling said concrete; and (b) an adjustable support assembly for said screed bar positioned near each end of said screed bar, said support assembly comprising;

(i) a vertical shaft having a sled runner attached at its lowermost end, said runner having a curved leading end to permit the runner to easily move through said concrete and over irregularities in said substrate; said shaft further having a vertical channel therein; and (ii) screed bar bracket means adjustably mounted upon said shaft upwardly of said runner comprising an L-shaped metal bracket receiving said screed bar, a pair of angle irons one end of each of which is secured to said metal bracket, the remaining end of each of which angle irons having an opening through which said shaft slides and a collar adjacent said opening and secured to said angle iron end; said collar having a locking thumbscrew which when operated secures said screed bar bracket means into said vertical channel in said shaft to thereby prevent said bracket means from moving vertically with respect to said shaft and also rotationally about said shaft.

2. The screed bar assembly of claim 1 further having means to pull the assembly over said substrate and through said concrete.

* * * * *